United States Patent [19]

Luckanuck

[11] Patent Number: 4,799,349

[45] Date of Patent: Jan. 24, 1989

[54] FIRE RESISTANT STEEL DOOR

[75] Inventor: John S. Luckanuck, Burlington, Canada

[73] Assignee: Radixx/World Ltd., Ontario, Canada

[21] Appl. No.: 12,628

[22] Filed: Feb. 9, 1987

[30] Foreign Application Priority Data

Apr. 4, 1986 [CA] Canada ..... 505877

[51] Int. Cl.[4] ..... E04C 2/34

[52] U.S. Cl. ..... 52/809; 52/232; 428/921

[58] Field of Search ..... 52/232, 809; 428/921

[56] References Cited

U.S. PATENT DOCUMENTS

| | | | |
|---|---|---|---|
| 427,362 | 5/1890 | Rapp | 52/792 |
| 1,581,038 | 4/1926 | Thompson | 52/809 |
| 2,593,050 | 4/1952 | Paul et al. | 52/232 |
| 3,566,564 | 3/1971 | Gaeth et al. | 52/232 |
| 3,570,199 | 3/1971 | Gartner | 52/168 |
| 3,819,518 | 6/1974 | Endler | 252/8.1 |
| 3,920,603 | 11/1975 | Stayner et al. | 523/220 |
| 4,043,862 | 8/1977 | Roberts | 162/135 |
| 4,074,015 | 2/1978 | Franz et al. | 428/526 |
| 4,102,794 | 7/1978 | Gandini et al. | 252/8.1 |
| 4,104,828 | 8/1978 | Naslund et al. | 49/399 |
| 4,282,687 | 8/1981 | Teleskivi | 49/503 |
| 4,365,001 | 12/1982 | Meyer et al. | 428/480 |
| 4,663,204 | 5/1987 | Langham | 428/12 |

FOREIGN PATENT DOCUMENTS

| | | | |
|---|---|---|---|
| 50-32286 | 10/1975 | Japan | 428/921 |
| 22689 | 8/1979 | Japan | 52/232 |
| 17585 | 2/1980 | Japan | 428/921 |
| 51560 | 4/1980 | Japan | 428/921 |
| 137149 | 10/1980 | Japan | 428/921 |
| 42456 | 3/1983 | Japan | 428/921 |

*Primary Examiner*—John E. Murtagh
*Assistant Examiner*—Andrew Joseph Rudy

[57] ABSTRACT

In order to provide a steel door with a fire rating sufficient to satisfy the Fire Regulations in North America which require in the fire rating endurance test that the temperature of the unexposed side of the steel door not to rise by more than 250° F. over a period of one hour, the steel door is provided with a high density bonded mineral fiber sheet as its core which is bonded to the inside surfaces of the steel sheets forming the outside surfaces of the door by a binder comprising a mixture of an alkali metal silicate and a mineral powder selected from aluminium trihydrate and wollastenite, the powder being present in an amount sufficient to cause said binder on being subjected to high temperature to intumesce thus protecting said sheet against the heat.

9 Claims, 1 Drawing Sheet

FIG. 1
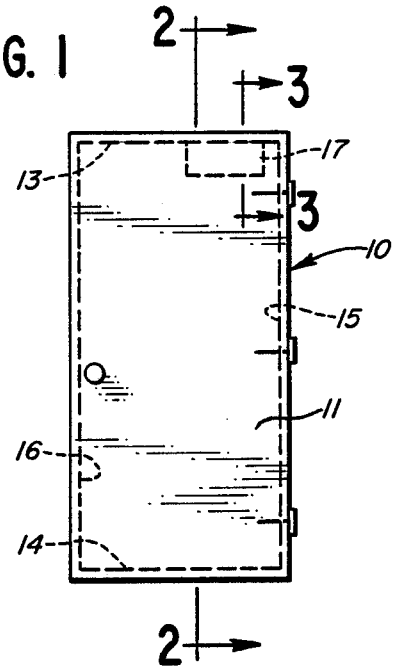
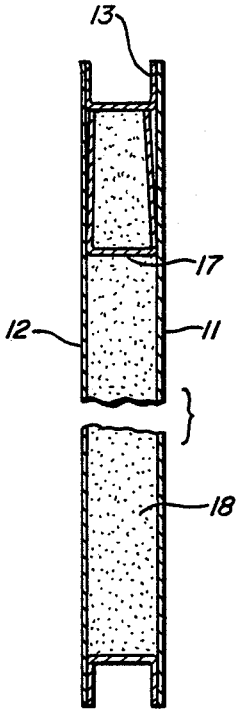
FIG. 2
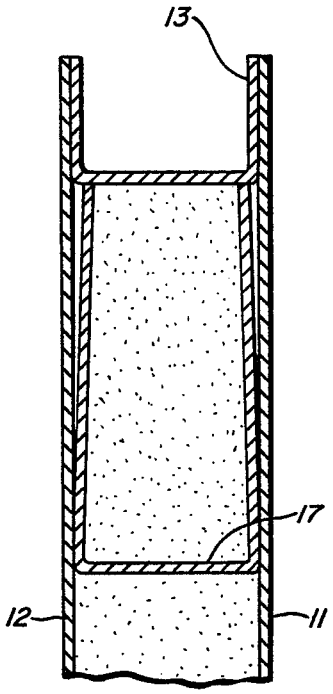
FIG. 3

FIRE RESISTANT STEEL DOOR

The present invention relates to steel doors and in particular to fire resistant steel doors.

In order to satisfy fire regulations and standards in Canada and the United States for use in the building industry, particularly in commercial and public buildings, steel doors are required to pass the 1½ hour fire endurance and hose stream test (CAN 4-S104 and ASTM E152). A critical requirement of this test is that on being subjected to a flame at 1850° F. for 1½ hours on one side of the door the other side of the door must not increase in temperature on average to over 250° C. after a period of 60 minutes. Steel doors conventionally comprise a steel frame surrounding a central core sheet usually of 1 ⅝ inch thickness with steel sheet suitably of 16, 18 or 20 gauge steel bonded to the surfaces thereof, with an adhesive. Heretofore, the core of such a door has been sheet polystyrene bonded to the inside surfaces of the steel sheets of the door with a resin adhesive. However, styrofoam has the disadvantage that it melts and disintegrates at the temperatures obtained within the door during the test and such steel doors while passing the other requirements of the 1½ hour fire endurance and hose stream test fail in the above requirement of temperature rise on the unexposed surface of the door for the 60 minutes and thus cannot be used in particular areas of the commercial and public buildings in view of the fire regulations.

It is an object of the present invention to provide a steel door which fully satisfies the requirements of the 1½ hour fire endurance and hose stream test, including the temperature rise requirement on the unexposed surface of the door, thus allowing the steel doors to be used in all parts of public and commercial buildings as required.

According to the present invention there is provided a steel door including a fire retardant core bonded to the inside surface of steel sheets forming the outside surface of the door, said core being a stiff, high density bonded mineral fiber sheet which is bonded to the inside surfaces of the sheet by a binder comprising a liquid alkali metal silicate admixed with a mineral powder which binder on being subjected to high temperatures intumesces and forms a ceramic layer between the inside surface of the steel sheet and the core.

The high density stiff, bonded, mineral fiber sheet is suitably one in which the mineral fibers are obtained from glass furnace slag and suitably has a density of from 96 to 192 kilograms per cubic meter or 6 to 14 pounds per cubic foot. Suitably the thickness of the sheet is sufficient to fill the cavity in the steel door provided for the core and is about 1 ⅝ inches thick. Such a fiber sheet is sold by the Roxul Corporation under the trademark RXL 60, RXL 80, RXL 100 and RXL 120. A typical specification of the loose wool fibers forming such a fiber bath is as follows:

| Chemical Analysis: | |
|---|---|
| Silica (as $SiO_2$) | 47–48% |
| Alumina (as $Al_2O_3$) | 8–8% |
| Ferric Oxide (as $Fe_2O_3$) | 0.6% |
| Calcium Oxide (as CaO) | 29% |
| Magnessia (as MgO) | 11% |
| Sodium (as $Na_2O$) | 1.0% |
| Potassium (as $K_2O$) | 1.0% |
| Loss on Ignition | 0.1–0.3% Dedust Oil |

-continued

| Chemical Analysis: | |
|---|---|
| Melting Point | 2300° F. |
| Continuous Operating Temperature | 1400° F. |
| Fibre Diameter | 4–6 Microns |
| Fibre Length | ⅛"–1" |
| Shot Content | 50 Mesh 3 to 5%<br>325 Mesh 40% |

However the Roxul sheets have heretofore generally has been used only as insulation and are very flexible and are usually bonded together with about 4% by weight phenolic resin. This is undesirable for even when the sheets are bonded to the inside surface of the steel sheets forming the door, the internal portions of the mineral fiber sheet tend to move on shaking the door. Therefore, it is desirable to increase the phenolic resin binder in the sheet to about 10% to provide the necessary stiffness and integrity throughout the sheet.

It is a critical feature of the invention that the sheet be bonded to the inside surfaces of the steel sheets forming the door by a fire retardant bonding agent. For this purpose the binder is a liquid alkali metal silicate, preferably sodium or potassium silicate and more preferably sodium silicate such as waterglass which contains a mineral powder which is present in an amount sufficient such that on such a binder being subjected to high temperatures the binder intumesces and forms a ceramic layer between the bonded mineral sheet and the inside surface of the steel sheets forming the door. Thus, for example, the mineral wool if allowed to be subjected to temperatures of 1800° F. to which the exposed surface of the door is subjected or melts well below that temperature, and for example, the Roxul mineral wood fiber sheet will melt at around 1200° F. However, the ceramic layers which are formed from the binder protect the mineral fiber sheet from such high temperatures and maintain its integrity without melting. As potassium silicates there may be used those supplied under the trademark KASIL by P.Q. Corporation such as KASIL 1; KASIL 88 and KASIL 6. Sodium silicates include those supplied by National Silicates Ltd. under the trademarks SS, SS 65, G, SSC and GD and by P.Q. Corporation under the trademarks Metso, Metso beads 2048, Metso pentabead 20 and Metso 20 as well as these soluble silicates supplied under the trademarks R; N; E; 0; K; M; STAR; RV; D; C and BWNDib 49 by National Silicates Limited. The mineral powder is most preferably aluminum trihydrate or wollastonite which are suitable present in an amount of 40 to 50% by weight and more preferably 40 to 45% by weight to obtain the non-porous ceramic layer between the steel sheet and the mineral fiber sheet. The aluminum trihydrate is in the form of a powder and is suitably one supplied under the trademark Hydrated Alumina Polyfil 130 and the wollastonite is a calcium silicate filler suitably supplied under the trademark Nyad or Nycor by the Nyco Division of Process Minerals Inc.

The phenolic resin is preferably a phenol aldehyde resin obtained by the condensation of phenol or a substituted phenol with an aldehyde such as for example, formaldehyde, acetaldehyde and furfural, particularly a phenol formaldehyde resin, such as supplied under the trademark Bakelite, PF117.

The present invention will be further illustrated by way of the following Examples:

EXAMPLE

A 1⅝ inch thick sheet of a bonded mineral fiber supplied under the trademark RXL 80 by Roxul which is a division of Standard Industries Ltd. was impregnated with a phenolic resin supplied under the trademark Bakelite PF117 to increase its phenolic resin content from 4% to 10% by weight and thus provide a higher stiffness in the sheet. The sheet was then bonded into the cavity of a conventional steel door using as the bonding agent a liquid mixture of 60% by weight sodium silicate and 40% by weight Nyad G. The door was then subjected to a 1½ hour fire endurance and hose stream test program in accordance with the requirements of Can 4-S104.

In the testing three thermocouples were attached to the outside of the unexposed surface of the door at three separate locations to give an average temperature of the rear surface of the door and temperatures were taken at 15, 30, 45, 60, 75, and 90 minutes. The results are as follows:

| Thermocouple Number | Temperature Rise Data (°C.) Elapsed Times (Minutes) 15 | 30 | 45 | 60 | 75 | 90 |
|---|---|---|---|---|---|---|
| 1 | 77 | 79 | 79 | 60 | 75 | 298 |
| 2 | 72 | 74 | 152 | 266 | 290 | 294 |
| 3 | 67 | 68 | 68 | 65 | 241 | 259 |
| Average | 72 | 74 | 100 | 177 | 274 | 284 |

NB Ontario Building Code Limit is 250° C. at 60 minutes when tested in accordance with CAN 4-S104.

It will be seen that the average temperature of the unexposed surface of the door after 60 minutes was well below 250° C. and the door thus qualified at a 1 hour temperature rise door.

EXAMPLE 2

A fire test program was effected on doors of similar construction to those of Example 1.

Testing was conducted in accordance with CAN4-S104, UL10(b), ASTM E152, and NFPA 252 on both an 8'0×8'0 standard pair and a 3'0×7'0 single door.

The exposed face temperature rise measurements verified compliance at 30 minutes with criteria of less than 130° C. average temperature rise on both assemblies. The 60 minute temperature rise on the single door averages 89° C. and temperature rise averaged 154° C. (L.H. door) and 119° C. (R.H. door) on the pair of doors. The individual high point was a rise of 299° C. at the upper thermocouple on the left door of the pair at 60 minutes.

Both the 8'0×8'0 pair and the 3'0×7'0 single met all test criteria of CAN4-S104, ASTM E152 UL10(b), and NFPA 252 for a one and one-half hour rating as temperature rise fire doors.

DESCRIPTION OF THE DRAWING

The invention is illustrated in the accompanying drawing, in which

FIG. 1 is a front elevational view of a fire resistant steel door formed in accordance with the invention;

FIG. 2 is an enlarged sectional view, partially broken away, taken a the line 2—2 of FIG. 1; and FIG. 3 is an enlarged fragmentary view of the upper portion of FIG. 2.

The door 10 includes front and back door faces 11 and 12 which are formed from 18 gauge satin coat steel. Top and bottom channels 13 and 14 are spotwelded to the upper ends of the faces 11 and 12, and side channels 15 and 16 are spotwelded to the side portions of the faces. Each of the channels 13-16 is formed from 16 gauge steel. A 14 gauge steel closer reinforcer channel 17 is tack welded to the top channel 13 adjacent the side of the door on which the hinges are mounted. A fire retardant core 18 prepared as previously described is bonded to the inside surfaces of the faces 11 and 12.

While in the foregoing specification a detailed description of specific embodiments of the invention were set forth for the purpose of illustration, it will be understood that many of the details herein given may be varied considerably by those skilled in the art without departing from the spirit and scope of the invention.

I claim:

1. A steel door having steel sheets forming the outside surfaces of the door including a fire retardant core bonded to the inside surfaces of said steel sheets, said core being a stiff, high density bonded mineral fiber sheet sheet having a phenolic resin content of about 4 to about 10% by weight bonded to the inside surfaces of the steel sheets by a binder comprising a liquid alkali metal silicate admixed with a mineral powder in an amount sufficient that on said binder being subjected to high temperatures it intumesces to form a non-porous ceramic layer between the inside surfaces of the steel sheets and the mineral fiber sheet thereby protecting said mineral fiber sheet from said high temperature.

2. The door as claimed in claim 1, in which the alkali metal silicate is sodium or potassium silicate.

3. The door as claimed in claim 1, in which the alkali metal silicate is sodium silicate.

4. The door as claimed in claim 3, in which the binder is essentially a mixture of sodium silicate and a mineral powder selected from aluminum trihydrate or wollastonite.

5. The door as claimed in claim 4, in which the binder consists essentially of 50 to 60% by weight of sodium silicate and 40 to 50% by weight of the mineral powder.

6. The door as claimed in claim 4, in which the binder comprises 55 to 60% by weight of the sodium silicate and 40 to 45% by weight of the mineral powder.

7. The door as claimed in claim 4, in which the mineral fiber is composed of a solidified molten blast furnace slag.

8. The door as claimed in claim 4, in which the mineral fiber sheet has a density of 6 to 14 pounds per cubic foot.

9. A door as claimed in claim 1, in which the phenolic resin content of the mineral fiber sheet is about 10% by weight.

* * * * *

UNITED STATES PATENT AND TRADEMARK OFFICE

CERTIFICATE OF CORRECTION

PATENT NO. : 4,799,349

DATED : January 24, 1989

INVENTOR(S) : John S. Luckanuck

It is certified that error appears in the above-identified patent and that said Letters Patent is hereby corrected as shown below:

Col. 4, line 29 delete the first occurrence of "sheet".

Signed and Sealed this

Sixth Day of June, 1989

*Attest:*

*Attesting Officer*

DONALD J. QUIGG

*Commissioner of Patents and Trademarks*